US006159679A

United States Patent [19]

Vandenbroucke

[11] Patent Number: 6,159,679

[45] **Date of Patent: *Dec. 12, 2000**

[54] PHOTOSENSITIVE IMAGE-FORMING ELEMENT CONTAINING INTERNALLY MODIFIED SILVER HALIDE CRYSTALS

[75] Inventor: Dirk Vandenbroucke, Boechout, Belgium

[73] Assignee: Agfa-Gevaert, N.V., Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 09/033,746

[22] Filed: Feb. 24, 1998

Related U.S. Application Data

[60] Provisional application No. 60/045,088, Apr. 29, 1997.

[30] Foreign Application Priority Data

Mar. 1, 1997 [EP] European Pat. Off. ..... 97200585

[51] Int. Cl.[7] ..... G03C 1/09

[52] U.S. Cl. ..... 430/605

[58] Field of Search ..... 430/605

[56] References Cited

U.S. PATENT DOCUMENTS

| | | | |
|---|---|---|---|
| 5,474,888 | 12/1995 | Bell | 430/567 |
| 5,480,771 | 1/1996 | Bell | 430/567 |
| 5,500,335 | 3/1996 | Bell | 430/567 |

FOREIGN PATENT DOCUMENTS

| | | | |
|---|---|---|---|
| 264288 | 4/1988 | European Pat. Off. | G03C 1/08 |

*Primary Examiner*—Hoa Van Le
*Attorney, Agent, or Firm*—Breiner & Breiner

[57] ABSTRACT

A photosensitive image-forming element comprising on a support at least one photosensitive layer containing silver halide crystals internally doped in the center of the crystal volume with a transition metal complex while satisfying equation (I):

$$0<FORM<10^{+5} \quad (I)$$

where $$FORM = \left(\frac{d_1}{d}\right)^3\left[1-\left(\frac{d_1}{d}\right)^3\right]Q \quad (II)$$

and where $d_1$ represents a spherical equivalent diameter (SED), expressed in $\mu$m, corresponding with a central crystal part doped with the said transition metal complex, d expressed in $\mu$m represents the SED of the whole crystalvolume, while Q represents the concentration of the transition metal complex, expressed in $10^{-9}$ mole per mole of silver halide and wherein the said transition metal complex has the following general formula (1):

$$[MX_nY_mL_q]^{r-} \quad (1)$$

wherein:

M represents a metal selected from the group consisting of an element from Group 5 up to Group 10 of the Periodic System of the Elements;

X and Y, which are different from each other, each represents one of the elements from the group consisting of Cl, Br and I;

L represents any anorganic or organic ligand but preferably a ligand selected from the group consisting of NO, NS, OH, $H_2O$, CN, CO, $CH_3CN$, CNS, NCS, $NO_2$, F, SeCN, CNSe, TeCN, CNTe, OCN, CNO, $N_3$ and COO;

n and m each equals an integer having a value from 0 to 6 while n+m equals 4, 5 or 6;

q equals 0, 1 or 2 while n+m+q=6 and r equals 1, 2, 3 or 4.

12 Claims, No Drawings

PHOTOSENSITIVE IMAGE-FORMING ELEMENT CONTAINING INTERNALLY MODIFIED SILVER HALIDE CRYSTALS

This application has the benefit of the provisional application Ser. No. 60/045,088 filed on Apr. 29, 1997.

FIELD OF THE INVENTION

The present invention relates to a photosensitive silver halide emulsion, a method for making such emulsion and a photosensitive material containing said emulsion. More specifically the present invention is related to a high sensitive silver halide photographic material with an increased image contrast.

BACKGROUND OF THE INVENTION

For several photographic applications the need exists to have the disposal of a reproduction material which exhibits increased image contrast upon exposure to radiation and subsequent processing. This need originates from the knowledge that image contrast (also called 'gradation') is directly related with the appearance of sharpness. Photographic products showing increased gradation are known therefore to exhibit a higher sharpness and a better quality of reproduced image details.

One way to increase gradation of an emulsion is by doping the emulsion with a metal ion or its complex. The metal ion or complex, also called dopant, is therefore supplied to the silver halide emulsion during precipitation and is incorporated in the internal crystal structure.

Depending on the concentration of dopants in said crystal structure the photographic properties will differ. The ligands of the dopant are also included in the crystal structure and will modify the photographic properties as well.

Generally an increase of gradation by addition of dopants is also accompanied by a decrease of sensitivity further depending on the kind of metal ion, its valency, ligand structure and amount of metal-complex added during precipitation.

This sensitivity decrease can advantageously be used to make less light-sensitive materials which can be handled under safelight conditions. In several graphic art applications these materials are e.g. used for roomlight operations, as in contact printing of halftone film materials where negative or positive copies are made from screened originals by dot per dot reproduction.

The dopants which will be discussed here are characterised by building a deep electron trap in a silver halide crystal lattice. Such trap is called 'deep' if following two conditions are fulfilled: the LUMO of the incorporated molecular entity should be at least 0.5 eV below the conduction band of the silver halide crystal, and the trapping life-time at room temperature should be higher than 0.2 seconds (see R. S. Eachus, M. T. Olm in 'Cryst.Latt.Def.and Amorph.Mat.', 1989(18)297–313). The LUMO is defined as the 'lowest unoccupied molecular orbital' of the related complex which can trap an electron from the conduction band (see D. F. Shriver, P. W. Atkins, C. H. Langford in "Inorganic Chemistry"-Oxford Univ.Press (1990), Oxford-Melbourne-Tokyo).

All patents which will be discussed hereinafter are related with transition metal complexes acting as deep electron traps. From a lot of patents related with this topic U.S. Pat. No. 4,933,272 from McDugle et al should be mentioned. This patent discloses doping agents containing a nitrosyl or thionitrosyl coordination ligand together with a transition metal from the groups 5 up to 10 (also including 10) of the periodic table of the elements. The same author describes dopants containing transition metal complexes with carbonyl-ligands in EP-A 0 415 481. In WO 92/16876 Beavers et al describe a combination of a homogeneously distributed deep electron trap (a transition metal complex with a nitrosyl ligand) and a more 'shallow electron trap' (an iridium salt) in the outer shell of the grain. The iridium-center is known to trap photo-electrons temporarily in some cases: at room temperature the electrons will be released in a characteristic time in the order of 0.02 to ca 10 seconds depending on the structure and composition of the silver halide host lattice (see R. S. Eachus and M. T. Olm in the literature cited above). Added in small amounts the said iridium dopant is especially in favour of an improvement of the high intensity reciprocity failure and latent image stability.

Increasing the contrast as much as possible needs a rather high amount of dopant homogeneously distributed over the crystal volume which is also required in order to keep maximum density and to prevent solarization. This has its consequences in using automatic processors where the increasing load of metal complexes by continuous processing asks for special attention in regeneration afterwards. The sensitometric problems as density-loss and solarisation can be solved by a method given by Gingello and Schmidt in EP-A 0 697 619 proposing a non-uniform incorporation of the same dopants. Therefore the metal complexes are built in mainly in the outer region of the crystals.

Most of the emulsions doped with the metal complexes mentioned hereinbefore have a high contrast but are suffering from low sensitivity (as is desired in the case of roomlight-handling). It is however unacceptable for other applications like the reproduction of colour negatives. Colour photography requires perfect matching of the characteristic curves of the blue, green and red sensitive emulsion layers. Control of contrast and of sensitivity for the different emulsions is necessary in order to get a final copy with an acceptable image quality.

Minimizing the sensitivity loss by use of a dopant in order to get a gradation increase is the special object for which a solution has to be found. Several patents are related with problems as loss in sensitivity by doping with metal complexes while a lot of applications on the contrary need a high gradation and a high sensitivity as well. Normally sensitivity or speed decreases when gradation increases and vice versa. Breaking through this 'sensitivity-gradation'-relationship is therefore the first object of these patents.

One solution which has been proposed frequently is a chemical ripening of such an emulsion with a labile selenium or tellurium compound. Yoshida e.g. in U.S. Pat. No. 5,348,850 suggests an increase in sensitivity while keeping a high contrast by chemical sensitization with labile Se- or Te-compounds and using a well defined rhodacyanine spectral sensitizer. In this case the Se- or Te-sensitization provides a deep trap at the crystal surface (giving high sensitivity) which is in competition with a deep internal electron trap (giving rise to a high gradation). This way of working normally results in a silver halide light sensitive photographic material which is very susceptible to fog formation. Another possibility to overcome the sensitivity problem can be realised with an adapted processing starting with a high sensitivity where the difference in developability of the latent image of the silver halide emulsion crystals is becoming very low because of the very high activity of the developing agent. This however can easily lead to the formation of fog.

In EP-A 0 552 650 a silver halide material is described which has an increased sensitivity by doping with a polyvalent metal complex. The polyvalent metal compounds used in this case are however not satisfying the conditions of having a DET-activity (DET=deep electron trap) incorporated in the silver halide microcrystals. The result which is realized in an iodide containing silver halide emulsion does not show an increase in gradation. It is also interesting to see that doping with the kind of compounds used in EP-A 0 552 650 in combination with a internal reduction sensitization does not lead to the desired increase of the gradation even if the complexed polyvalent metal ion is incorporated in the center of the grain as is teached therein.

However the problem of sensitivity-loss in doped emulsion crystals can be solved by adding a second type of dopant. This can be a temporary electron trap as $IrCl_6^{3-}$ or even a more shallow electron trap as $Ru(CN)_6^{4-}$ or $Fe(CN)_6^{4-}$ which can be locally concentrated within a certain area of the crystal volume. This has e.g. been demonstrated by Asami in EP-A 0 423 765 wherein doping with ferri- or ferro-complexes in the outer space area of the AgCl(Br)-crystal gives an increase of gradation and a decrease of loss in sensitivity. In U.S. Pat. No. 5,051,344 Kuno teaches that doping with ferro- or iridium(+3)-ions in the crystal shell of the silver halide emulsion gives a higher gradation and sensitivity. The same effect is described by Oozeki and Ikari in JP-A 6-222487 with a Ru-, Fe- or Ir-complex in the surface area of the crystal.

The activity of deep electron traps is also demonstrated by three patents issued to Bell: U.S. Pat. No. 5,474,888, U.S. Pat. No. 5,480,771 and U.S. Pat. No. 5,500,335 propose the use of an $[Os(NO)Cl_5]^{2-}$ complex which is uniformly distributed throughout the crystal or on its surface which gives a very small gradation increase by an equal or little lower sensitivity. For tabular crystals Olm et al (U.S. Pat. No. 5,503,970), Daubendiek et al (U.S. Pat. No. 5,503,971) and Kuromoto et al (US-A 5,462,849) suggest that doping in epitaxilly grown protrusions gives an increase in gradation and sensitivity.

Doping in outer regions of the silver halide crystal volume however may lead to interactions between additives added during chemical sensitization and before coating on one hand and superficially present metal ions at the other hand. These interactions can easily influence preservation properties of the chemically ripened emulsion, thereby asking for new measures in order to prevent such disadvantageous influences.

As discussed hereinbefore film systems were related with preservation of sensitivity while increasing gradation or they were focussed on getting improved sensitivity for the same gradation. To summarize: all these patents were targeting the same goal which will be called hereinafter "getting a better sensitivity-gradation-relationship".

OBJECTS OF THE INVENTION

It is therefore a first object of the present invention to provide an improved method of doping a light-sensitive silver halide photographic emulsion in order to provide a better sensitivity-gradation-relationship for said emulsion after processing of an exposed light-sensitive photographic material coated with said emulsion.

It is a further object of the present invention to provide a method which needs a smaller amount of dopant in favour of ecology, in order to get a better sensitivity and an almost unchanged gradation.

It is a further object of the present invention to provide a method for making a light-sensitive silver halide photographic material using a silver halide emulsion with an increased sensitivity-gradation-relationship as mentioned hereinbefore.

It is moreover an object of the present invention to provide a method for increasing the photographic activity of a dopant incorporated in a silver halide emulsion.

Further objects of the present invention will become apparent from the description hereinafter.

SUMMARY OF THE INVENTION

The above mentioned objects are realised by a photosensitive image-forming element comprising on a support at least one photosensitive layer containing silver halide crystals internally doped in the center of the crystal volume with a transition metal complex while satisfying equation (I):

$$0<FORM<10^{+5} \quad (I)$$

where $$FORM = \left(\frac{d_1}{d}\right)^3\left[1-\left(\frac{d_1}{d}\right)^3\right]Q \quad (II)$$

wherein $d_1$ represents a spherical equivalent diameter (SED), expressed in $\mu$m, corresponding with a central part of said crystal doped with the said transition metal complex, d expressed in $\mu$m represents a SED representing the whole crystal while Q represents the concentration of the transition metal complex, expressed in $10^{-9}$ mole/mole of silver halide and wherein the said introduced transition metal complex has the following general formula (1):

$$[MX_nY_mL_q]^{r-} \quad (1)$$

wherein:

M represents a metal selected from the group consisting of an element from Group 5 up to Group 10 of the Periodic System of the Elements;

X and Y, which are different from each other, each represent one of the elements selected from the group consisting of Cl, Br and I;

L represents any anorganic or organic ligand but preferably a ligand selected from the group consisting of NO, NS, OH, H2O, CN, CO, CH3CN, CNS, NCS, NO2, F, SeCN, CNSe, TeCN, CNTe, OCN, CNO, $N_3$ and COO;

n and m each equals an integer having a value from 0 to 6 while n+m equals 4, 5 or 6;

q equals 0, 1 or 2 while n+m+q=6 and r equals 1, 2, 3 or 4.

The spherical equivalent diameter (SED) of the crystal represents the diameter of the sphere which has the same volume as the average volume of the silver halide crystals of the said emulsion.

Preferred embodiments of the invention are disclosed in the dependent claims.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appending claims.

The precipitation of a photosensitive silver halide emulsion is conducted in an aqueous dispersing medium including, at least during grain growth, a peptizer wherein silver ions and halide ions are brought together. Grain structure and properties can be selected by control of several parameters like precipitation temperature, pH and relative proportion of the silver and halide ions in the dispersing medium. In order to avoid fog formation the precipitation is commonly conducted on the halide side of the equivalence point which is defined as 'the point at which the silver and halide ion activity is equal'.

The silver halide emulsions of the current invention are prepared in the presence of compounds which can be occluded in the crystal structure. Such a compound (also called dopant) is replacing an appropiate amount of silver and halide ions in the silver halide lattice. The dopant can be distinguished from the metal-complex introduced in the emulsion as an additive by EPR- or ENDOR-techniques. The EPR-technique and sample preparation is described in U.S. Pat. No. 5,457,021 by Olm et al and by H. Vercammen, T. Ceulemans, D. Schoenmakers, P. Moens and D. Vandenbroucke in Proc. ICS&T of 49$^{th}$ Ann.Conf., p.54 (May 19–24, 1994 Minneanapolis). The description of the ENDOR-technique is given in the same Proc.Ann.Conf., p.56 by P. Moens, H. Vercammen, D. Vandenbroucke, F. Callens and D. Schoenmakers. These so-called dopants are modifying the crystal structure and are further influencing the properties of the crystal. A lot of parameters like sensitivity, gradation, pressure sensitivity, high or low intensity reciprocity failure, stability, dye desensitization, and several other sensitometric aspects of a photosensitive silver halide emulsion can be modified by selection of the dopant, including its concentration, its valency and location in the crystal in case of incorporation of the single metal ion. When coordination complexes or even oligomeric coordination complexes are used the different ligands bound at the central metal ion can be occluded in the crystal lattice too and can in this way influence the photographic properties of the silver halide material as well (Res.Discl.,38957 (1996) pag 591, section I-D). The dopant utilized in accordance with the present invention is a transition metal complex which can be defined by the general formula (1) as described hereinbefore.

Dopants which can be utilised with respect to the objects of the present invention should be incorporated in the silver halide crystals in such a way that they satisfy equation (I) hereinbefore. It is important to know that the lowest value of 'FORM' is equal to zero. This actually happens if a low amount of dopant is located in the extreme center of the crystal or in the contrary almost reaches its surface.

Introducing one or more dopants in the silver halide emulsion normally tends to increase the gradation of the image-forming element comprising the said emulsion after subsequent illumination and processing. It is frequently accompanied by a decrease in photographic sensitivity. This characteristic is used advantageously in photosensitive image-forming elements for roomlight or daylight operations. As discussed already before, the location of the dopant plays a dominant role in the fine tuning of the sensitometric characteristics of the material comprising the emulsion containing one or more dopants. It is utilised advantageously in several inventions where the dopant is non-uniformly distributed in the silver halide crystal. Delocalisation of the dopant as described in patents mentioned in 'the Background of the Invention' are resulting in an improvement of the photographic sensitometry (as sensitivity, stability, gradation and so on). In all these proposals the dopants are introduced in the outer regions of the silver halide crystals which easily leads to interactions between the molecules of the dopants superficially present in the silver halide crystals at one side and chemical addenda at the other side which are distributed in a dispersion surrounding the grains and which are necessary for the chemical sensitization and in a later phase of the emulsion production process for the coating of the ripened silver halide emulsion on the base.

Introducing the dopants according to the general formula (1) in the photosensitive silver halide crystals of the present invention leads to an image-forming element with improved quality with respect to gradation and sensitivity if the conditions for the location and concentration of the dopant are satisfied as stated in the equations (I) and (II) of the present invention.

That means that the dopants should be incorporated in the center of the crystals starting almost from the center up to 95% of the average diameter of the emulsion crystals, but preferable up to not more than 75%, and more preferably up to max 50% of the average crystal diameter of the emulsion crystals. It is important to know that the doping procedure always can start just after ending the nucleation step in order to avoid interference of dopants in the formation of the nuclei. Preferably this corresponds with addition of the said dopants after having precipitated about 3% of silver halide, more preferably about 5%.

Dopants which can be used for this invention according to formula (1) are essentially those which act as a deep and permanent electron trap in a silver halide crystal and which satisfies (as taught already before) two conditions: the LUMO of the incorporated molecular entity should be at least 0.5 eV below the conduction band of the silver halide crystal, and the trapping life-time at room temperature should be longer than 0.2 seconds (see R. S. Eachus, M. T. Olm in 'Cryst.Latt.Def.and Amorph.Mat.', 1989(18) 297–313). The LUMO is defined as the 'lowest unoccupied molecular orbital' of the related complex which can trap an electron from the conduction band (see D. F. Shriver, P. W. Atkins, C. H. Langford in "Inorganic Chemistry'—Oxford Univ.Press (1990), Oxford-Melbourne-Tokyo). Examples of these traps can be find in EP-A 0 606 895, EP-A 0 415 481, U.S. Pat. No. 4,835,093 and in U.S. Pat. No. 5,348,850.

The doping procedure itself can normally be executed at any stage during the grain growth phase of the emulsion preparation where the reactants are added to the reaction vessel in the form of solutions of silver and halide salts or in the form of preformed silverhalide nuclei or fine grains which easily dissolve in the precipitation medium. It is important to know that the dopants can also be added in an indirect way by addition of a dispersion containing very fine soluble silver halide grains or nuclei comprising the dopant.

The individual reactants can be added through surface or subsurface delivery tubes by hydrostatic pressure or by an automatic delivery system for maintaining the control of pH and/or pAg in the reaction vessel and of the rate of the reactant solutions introduced in it. The reactant solutions or dispersions can be added at a constant rate or a constantly increasing or fluctuating rate, if desired in combination with stepwise delivery procedures. More details about the possible ways in making a silver halide emulsion which can be principally used in practizising this invention are summarized in Res.Discl.,38957 (1996)591–639 section I-C.

Special attention has to be paid to the way the dopants are introduced during the grain growth process. The stability of the metal ligand complex in the solution can be very limited. Therefore the solution containing the dopants is preferentially introduced via a third jet, in a zone in the reactor where the compounds are rapidly incorporated in the growing microcrystals. The advantage of the use of a third jet is that a solvent can be used for the given dopant which is most suitable for the stability of that compound. Further the temperature of the dopant solution can be adjusted in order to maximize the stability too. The most stable conditions for the dopant solution are tested by UV-VIS absorption. The third jet itself can be adjusted automatically or manually. The dopant can be added at a constant rate or at any rate profile as for instance in JP-A 03 163 438 wherein the dopant is occluded in two different concentrations in the silver halide grains of a direct positive emulsion having the highest concentration closest to the grain centre. This patent describes a method to get a silver halide emulsion with improved gradation without paying attention to the sensitivity level which in the contrary is also the target of the present invention.

The photographic emulsions prepared in this way contain silver halide crystal comprising chloride, bromide or iodide alone or combinations thereof. Other silver salts which can be incorporated in a limited amount in the silver halide lattice are silver phosphate, silver thiocyanate, silver citrate and some other silver salts. The chloride and bromide halide can be combined in all ratios to form a silverchlorobromide salt. Iodide ions however can be coprecipitated with chloride and/or bromide ions in forming a iodohalide with an iodide amount which depends on the saturation limit of iodide in the lattice with the given halide composition; this means up to a maximum amount of about 40 mole percent in silver iodobromide and up to at most 13 mole procent in silver iodochloride both based on silver.

The composition of the halide can change in the crystal in a continous or discontinous way. Emulsions containing crystals composed of various sections with different halide compositions are used for several photographic applications. Such a structure with a difference in halide composition between the center and the rest of the crystal (what is called 'core-shell'-emulsion) or with more than two crystal parts differing in halide composition (called a 'band'-emulsion) may occur. The changes in halide composition can be realised by direct precipitation or in an indirect way by conversion where fine silver halide grains of a certain halide composition are dissolved in the presence of the so-called host grains forming a 'shell' or 'band' on the given grain. The crystals formed by the methods described above have a morphology which can be tabular or non-tabular like cubic, octahedral, etc. In tabular crystals the aspect ratio (ratio of equivalent circular diameter to thickness) can vary from low (<2) over 'medium' (2 till 8) to high (>8) where specially in the case of the ultra thin tabular crystals high aspect ratios can be realised. The major faces of the formed tabular grains can have a {111} or a {100}-habitus the structure of which is (respectively) stable or has to be stabilised (for instance by a 'habitus modifying agent'). In the class of non-tabular grains there are a lot of possibilities which can be divided in the more regular shaped crystals or the crystals with a mixed crystal habit.

The photographic emulsion of the present invention contains chloride, bromide and iodide as well, preferable chloride and bromide, and most preferred chloride without excluding the presence of the other halides. The present invention is suitable for an application in high speed camera-films, in radiographic materials, in graphic art films, in color paper and in others. Therefore a great variety of halide combinations should be covered. However for the chloride containing silver halides as AgClBrI, AgClI and AgClBr the prefered chloride concentration is at least 10 mol % and most prefered not less than 50 mol % which conditions are also encountered in many other silver halide photographic systems like those which are described e.g. in EP-A 0 264 288 and EP-A 0 552 650.

The present invention is applicable to crystals comprising any combination of halides which can even occasionally exist together with other silver salts as mentioned above. It is important to note that physical grain structures with two or more different halide compositions in one crystal can be used in combination with partially doping according the present invention. It is also interesting to know that the central part of the crystal doped according to the present invention does not necessarily need to cover the central part(s) of the same crystal which are distinguished from the other parts of the crystal by a difference in halide composition. This means that a internally doped crystal can match more than one crystal part with different halide compositions.

The emulsions can include silver halide grains of any conventional shape or size. Specifically the emulsions can include coarse, medium or fine silver halide grains. The silver halide emulsions can be either monodisperse or polydisperse after precipitation.

Besides the dopants which are deep electron traps as described by formula (1) other dopants can be added to the silver halide emulsion. These are essentially introduced because of their specific influence on the photographic characteristics. Different classes of dopants are known: dopants (such as $IrCl_6^{3-}$) resulting in a non-permanent trapping behaviour can be a shallow electron trap (such as $Ru(CN)_6^{2-}$) (see Res.Discl.,36736 (1994)657.), or a recombination or hole trapping center. These dopants are essentially all those not obeying the conditions for a deep electron trap. Many examples of this category have already been described in the patent literature but cover different silver halide systems like those mentioned hereinbefore in WO 92/16876, EP-A 0 264 288, EP-A 0 552 650 and EP-A 0 752 614.

After precipitation the emulsions can be coagulated and washed in order to remove the excess soluble salts. These procedures are together with different alternative methods like dia- or ultrafiltration and ion-exchange described in Res.Discl., 38957(1996), section III. The silver halide emulsions of this invention which are prepared in one of the ways described hereinbefore contain crystals which have a spherical equivalent diameter (SED) of not more than 1.0 $\mu$m but preferable less than 0.5 $\mu$m. The spherical equivalent diameter (SED) of the crystal represents the diameter of the sphere which has the same volume as the average volume of the silver halide crystals of the said emulsion.

The emulsions can be surface-sensitive emulsions which form latent images primarily on the surface of the silver halide grains or they can be emulsions forming their latent-image primarily in the interior of the silver halide grain. Further the emulsions can be negative-working emulsions such as surface sensitive emulsions or unfogged internal latent image-forming emulsions. However direct-positive emulsions of the unfogged, latent image-forming type which are positive-working by development in the presence of a nucleating agent, and even pre-fogged direct-positive emulsions can be used in the present invention.

The silver halide emulsions can be surface-sensitized by chemical sensitization which can be done in many different ways, in presence of a chalcogen as sulfur, selenium or tellurium, in presence of a noble metal as for instance gold or in combination with a chalcogen and noble metal. In a particular embodiment a sulphur sensitizer can be added in form of a dispersion of solid particles as has been described in EP-A 0 752 614. This can also be done by reduction sensitization if desired combined with the chalcogen/noble metal-sensitization. The presence of certain 'modifying' agents as for instance spectral sensitizers which can optimize the chemical sensitization process are often used. A complete description of all the different possibilities with respect to this subject can be found in Res.Discl.,38957 (1996), section IV.

In a next step the silver halide emulsions are spectrally sensitized with dyes from different classes which include polymethine dyes comprising cyanines, merocyanines, tri-tetra- and polynuclear cyanines and merocyanines, oxanols, hemioxanols, styryls, merostyryls and so on. Sometimes more than one spectral sensitizer may be used in the case that a larger part of the spectrum has to be covered. Combinations of several spectral sensitizers are sometimes used to get supersensitization, which means that in a certain region of the spectrum the sensitization is greater than that from any concentration of one of the dyes alone or that which would result from the additive effect of the dyes. Generally supersensitization can be attained by using selected combinations of spectral sensitizing dyes and other addenda such as stabilizers, development accelerators or inhibitors, brighteners, coating aids, and so on. A good description of all the possibilities in spectral sensitization which are important with respect to this invention can be found in Res.Discl., 38957(1996) section V.

In the case that desensitizers should be used, as for instance in pre-fogged direct-positive or in daylight handling materials, various chemical compounds are proposed for practical use. Principally all these compounds which are used as desensitizers in silver halide materials and which are for instance summarized in EP-A 0 477 436 can be used in combination with the elements of this invention.

The photographic elements comprising the said silver halide emulsions can include various compounds which should play a certain role in the material itself or afterwards in the processing, finishing or warehousing the photographic material. These products can be stabilizers and anti-foggants (see Res.Discl., 38957(1996) section VII), hardeners (see Res.Discl.,38957(1996) section IIB), brighteners (see Res.Discl.,38957(1996) section VI), light absorbers and scattering materials (see Res.Discl.,38957(1996) section VIII), coating aids (see Res.Discl.,38957(1996) section IXA), antistatic agents (see Res.Discl.,38957(1996) section IXC), matting agents (see Res.Discl.,38957(1996) section IXD) and development modifiers (see Res.Discl.,38957 (1996) section XVIII). The silver halide material can also contain different types of couplers, which can be incorpated as described in Res.Discl.,38957(1996) section X.

The photographic elements can be coated on a variety of supports as described in Res.Discl.,38957(1996) section XV and the references cited therein. The photographic elements can be exposed to actinic radiation, specially in the visible, near-ultraviolet and near-infrared region of the spectrum, to form a latent image (see Res.Discl., 38957(1996) section XVI).

This latent-image can be processed in order to form a visible image (see Res.Discl.,38957 (1996) section XIX). While the invention is specially focussed on Cl-containing photosensitive silver halide materials, automatic processing is advantagely used in order to get rapid and convenient processing. In order to prevent the disadvantages (as for instance the formation of silver sludge) of automatic processing these materials a preferred method of processing is described in EP-A 0 732 619. The developer mentioned in the last reference contains a combination of hydrochinon, an auxiliary developing agent, ascorbic acid or one of its isomers or derivatives, and a small amount of a thiocyanate salt. In more general terms this has already been described for silver halide systems as those mentioned e.g. in EP-A 0 552 650 and EP-A 0 752 614. But it is recommended to apply the method and to use the various ascorbic acid analogues as described in EP-A 0 732 619, which is incorporated herein by reference.

Processing to form a visible dye image for colour materials means contacting the element with a colour developing agent in order to reduce developable silver halide and to oxidize the colour developing agent which in turn normally reacts with the coupler to form a dye (see Res.Discl.,38957 (1996) section XX)

Having described in detail preferred embodiments of the current invention, it will now be apparent to those skilled in the art that numerous modifications can be made therein without departing from the scope of the invention as defined in the claims mentioned hereinafter.

The invention can be better appreciated by reference to the following specific examples. They are intended to be illustrative and not exhaustive about the requirements of the invention as described herinbefore and as summarized in the claims nailing on to the essentials of this invention. The present invention, however, is not limited thereto.

EXAMPLE 1

Preparation of emulsion A1:

| | |
|---|---|
| Solution A1: | |
| gelatin | 75 g |
| demineralised water | 1500 ml |
| $AgNO_3$ | 0.04 g |
| Solution A2: | |
| $AgNO_3$ | 750 g |
| demineralised water | 1500 ml |
| Solution A3: | |
| NaCl | 257.7 g |
| demineralised water | 1500 ml |
| Solution Dot1: | |
| NaCl | 225 g |
| acetic acid | 5 ml |
| demineralised water added to make | 1 l |
| $K_2[RuCl_5(NO)]$ | $1.372\ 10^{-3}$ g |

The pH of the solutions A1 and A3 was brought to a pH of 2.8 using a sulphuric acid solution. The solutions A2 and A3 were kept at room temperature, while solution A1 was heated to 50 degree C. The pAg was set to 7.05 using a sodium chloride solution. Solution A2 was added to solution Al at a constant rate, while solution A3 was added at a rate in order to keep the pAg constant at pH=7,05 during 3 minutes. Afterwards the addition rate for solution A2 was slighlty raised while the addition rate of solution A3 was varied in order to raise the pAg over 0.5 units in 4 minutes. Solution A2 was further added at an accelerating rate of 0,202 ml/minute, while solution A3 was added at a rate sufficient to keep the pAg constant at 7,5.

The emulsion was diafiltrated afterwards to a volume of 2.5 1 and desalted by ultrafiltration at constant pAg=7.8. After the washing procedure 150 g of gelatin was added to the precipitate and water was added in order to obtain a total weight of 3.75 kg.

The thus prepared silver chloride emulsion has a homodisperse grain size distribution, having an average grain size of 0.42 μm and a variance of about 15% in grain size.

Emulsions A2 to A5 were prepared in the same way, while the addition of 159 ml of the solution Dotl, containing a Ru-complex, to solution A1 was carried out at a constant rate using a third jet at different moments during the precipitation. The position of the dopant in the emulsion grains is expressed as the percentage of the crystal volume reached at the moment where the addition of the third jet is started and the percentage of the crystal volume at the moment where the addition of the dopant solution is stopped. The location of the dopants, the grain diameter d, the diameter $d_1$ of the sphere containing the dopant situated as far as possible from the grain centre, the value of the parameter FORM [see formula (II)] and the concentration of the dopant are shown in table A.1. The silver chloride emulsions were subsequently ripened at a pAg and pH equal to 7.9 and 4.6 respectively, with a gold tetrachloride solution (5 $10^{-7}$ mole/mole Ag) and a dimethylcarbamoylsulfide compound ($10^{-6}$ mole/mole Ag) at 50 degrees C for 150 minutes. These emulsions were spectrally sensitized with a blue sensitizer. The pH was adjusted to a value of 5.2 afterwards.

TABLE A.1

Location and concentration of the $RuCl_5NO$-dopant in an AgCl crystal.

| | Location | Conc. ($10^{-9}$ mole/mole Ag) | d (μm) | $d_1$ (μm) | FORM |
|---|---|---|---|---|---|
| A1 | — | — | 0.420 | — | 0 |
| A2 | 5–100% | 128 | 0.422 | 0.422 | 0 |
| A3 | 5–80% | 128 | 0.424 | 0.394 | 20 |
| A4 | 5–20% | 128 | 0.429 | 0.251 | 21 |
| A5 | 80–100% | 128 | 0.423 | 0.423 | 0 |

The emulsions were coated on a substrated PET base in an amount of 4 g of gelatin/$m^2$ and 2.5 g Ag/$m^2$. A layer containing gelatin (0.5 g per $m^2$), a vinylsulphonic hardener and surfactants were coated on top of the emulsion layer.

The photographic materials were image-wise exposed through a step-wedge original using a $10^{-3}$ sec Xe flash. The exposed photographic materials were developed in a G101 commercial developer using a Rapiline 66-3 machine at 35 degree C for 25 sec, and fixed at 33 degree C for 25 sec in a G 333c commercial fixer to which a hardener (Aditan) was added. All these commercial products are trademarket names from Agfa-Gevaert.

The fog level is low for all the materials, i.e. 0.03 to 0.04. The relative speed is the logarithm of the ratio of the energy of the illumination needed in order to obtain an optical density equal to the density $D=(D_{max}-D_{min})/2$, i.e. at the density where about 50% of the coated silver halide is image-wise reduced, relative to the energy to get the same density of the non-doped emulsion. A positive number indicates that more energy is needed by exposing in order to obtain the same optical density. A more positive number is indicative for a less sensitive emulsion. The contrast is measured around this sensitivity point (between 25% and 75% of density). The relative contrast is expressed as the ratio (in percentage) of the contrast of the doped emulsion versus the non-doped emulsion. The sensitivity and contrast in the shoulder portion of the sensitometric curve are derived in a similar way. This sensitivity is the illumination energy in order to get a density $D=0,8(D_{max}-D_{min})$ of the doped emulsion relative to the illumination energy to get the same density of the non-doped emulsion, while the contrast in the shoulder of the sensitometric curve is measured between 70 and 90% of the density $D=(D_{max}-D_{min})$. The sensitometric parameters are given in table A.2.

The advantages of the actual invention becomes most evident in the experiments where values of the parameter FORM obey equation (I), especially in the shoulder of the sensitometric curve. The 'normal'- and the 'shoulder'-contrast are significantly influenced by the location of the dopant in the microcrystals. The results clearly show that the 'overall' doping (A2) gives a strong

TABLE A.2

Influence of the location of the $RuCl_5(NO)^{2-}$ dopant on the (shoulder-)sensitivity and contrast.

| | Location | Relative Sens. | Relative contrast (%) | Relative Shoulder sens. | Shoulder contrast (%) | |
|---|---|---|---|---|---|---|
| A1 | — | — | 100 | — | 100 | Comparative |
| A2 | 5–100% | .63 | 221 | .53 | 218 | Comparative |
| A3 | 5–80% | .66 | 222 | .54 | 292 | Invention |
| A4 | 5–20% | .69 | 253 | .56 | 250 | Invention |
| A5 | 80–100% | .51 | 153 | .43 | 119 | Comparative |

contrast increase and a decrease in sensitivity (factor 4!) if compared with the non-doped emulsion (A1). It is further clearly demonstrated that 'moving' the dopant to the shell of the crystals (A2 to A5) gives a decrease in contrast and a small increase in sensitivity (as in A2), while introducing the dopant more to the center of the crystals (going from A2 to A3 to A4, thus locating the dopant in a band from 5–100%, over 5–80% to 5–20%) further increases the contrast while almost no decrease in sensitivity is observed. Increasing the concentration of the dopant in A2 in order to enhance the contrast to the value obtained for emulsion A4 would result in a much lower sensitivity.

This permits to reach a higher practical maximum density as required for instance in graphical applications using a laser recorder exposure.

EXAMPLE 2

Preparation of AgCl-emulsion B1:

| | |
|---|---|
| Solution B1: | |
| gelatin | 75 g |
| demineralised water | 1500 ml |
| $AgNO_3$ | 0.04 g |
| Solution B2: | |
| $AgNO_3$ | 750 g |
| demineralised water | 1500 ml |
| Solution B3: | |
| NaCl | 257.7 g |
| demineralised water | 1500 ml |
| Solution Dot2: | |
| NaCl | 225 g |
| acetic acid | 5 ml |
| demineralised water | |

-continued

| Preparation of AgCl-emulsion B1: | |
|---|---|
| added to make | 1 l |
| $K_2[RuCl_5.(NO)]$ | 6.9 $10^{-3}$ g |

The pH of the solutions B1 and B3 was brought to a pH value of 2.8 using a sulphuric acid solution. The solutions B2 and B3 were kept at room temperature, while solution B1 was heated to 50 degree C. The pAg was set to 7.05 using a sodium chloride solution. Solution B2 was added to solution B1 at a constant rate at 5 ml/min., while solution B3 was added at a rate in order to keep the pAg constant during 3 minutes. Afterwards the addition rate for solution B2 was slighlty raised up to 6.2 ml/min. while the addition rate of solution B3 was varied in order to raise the pAg over 0.5 units in 4 minutes. Solution B2 was further added at an accelerated rate of 0.202 ml/min., while solution B3 was added at a rate sufficient to keep pAg constant.

The emulsion was diafiltrated afterwards to a volume of 2.5 l and desalted by ultrafiltration at constant pAg of 7. After the washing procedure 150 g of gelatin was added to the precipitate and demineralised water was added in order to get a total weight of 3.75 kg.

The thus prepared silver chloride emulsion has a homodisperse grain size distribution, having a mean grain size of 0.42 $\mu$m and a variance of about 15% in grain size.

Emulsions B2 to B3, also containing AgCl were prepared in the same way, except for the addition of 15.9 ml of the solution Dot2, containing the same Ru-complex as in example 1, which was added to solution B1 at a constant addition rate using a third jet at different moments during the precipation. The position of the dopant in the emulsion grains is expressed as the percentage of the crystal volume at the moment where the addition of the third jet is started and the percentage of the crystal volume at the moment where the addition of the dopant solution is stopped. The location of the dopants and the grain size are shown in table B.1.

The AgBr-emulsions B4 to B6 were prepared in a similar way:

| | |
|---|---|
| Solution B4: | |
| gelatin | 75 g |
| demineralised water | 1500 ml |
| $AgNO_3$ | 0.04 g |
| Solution B5: | |
| $AgNO_3$ | 750 g |
| demineralised water | 1500 ml |
| Solution B6: | |
| KBr | 524.8 g |
| demineralised water | 1500 ml |

The pH of the solutions B4 and B6 was brought to a pH of 2.8 using a sulphuric acid solution. The solutions B5 and B6 were kept at room temperature, while solution B4 was heated to 50 degree C. The pAg was set to a value of 6.4 with a potasium bromide solution. Solution B5 was added to solution B4 at a constant rate of 1.25 ml/min. while solution B6 was added at a rate in order to keep the pAg constant at 6.4 during 3 minutes. Afterwards the pAg was raised to 8.14 using solution B6. Solution B5 was further added at an acceleration rate 0.133 ml/min., while solution B6 was added at a rate sufficient to keep the pAg constant at 8.14.

The emulsion was diafiltrated afterwards to a volume of 2.5 1 and desalted by ultrafiltration at constant pAg of 8.3. After the washing procedure 150 g gelatin was added to the precipitate and demineralised water was added to get a total weight of 3.75 kg. The thus prepared silver bromide emulsion has a homodisperse grain size distribution, with a mean grain size of 0.34 $\mu$m and a variance of about 8% in grain size.

Emulsions B5 and B6 were prepared in the same way as emulsion B4, except that these emulsions were doped with a Ru complex as indicated in table B.1. The addition of 17.9 ml of the dopant solution Dot2 to solution B4 during the precipition of the AgBr was carried out by using a third jet.

The silver chloride emulsions were subsequently ripened at a pAg and pH equal to 7.9 and 4.6 respectively, with a gold salt (5 $10^{-7}$ mole/mole Ag) and a sulfur compound ($10^{-6}$ mole/mole Ag) at 50 degrees C for 150 min. The emulsions were further stabilized with triazaindolizine. A part of these emulsions was spectrally sensitized with a green light-absorbing sensitizer. The pH was afterwards adjusted to a value of 5.2. The emulsions were coated on a substrated PET base in an amount of 4 g of gelatin per $m^2$ and 2.5 g Ag/$m^2$. A layer containing gelatin (0.5 g gel/$m^2$), a vinyl sulphonyl hardener and surfactants was coated on top of the

TABLE B.1

$RuCl_5NO$-dopant situated at different locations of an AgCl— and AgBr-crystal.

| Nr | | Location | Conc. ($10^{-9}$ mole/mole Ag) | d ($\mu$m) | d1 ($\mu$m) | FORM |
|---|---|---|---|---|---|---|
| B1 | AgCl | — | — | 0.425 | — | — |
| B2 | AgCl | 5–20% | 64 | 0.423 | 0.247 | 11 |
| B3 | AgCl | 80–100% | 64 | 0.434 | 0.434 | 0 |
| B4 | AgBr | — | — | 0.348 | — | — |
| B5 | AgBr | 5–20% | 72 | 0.328 | 0.192 | 12 |
| B6 | AgBr | 80–100% | 72 | 0.343 | 0.343 | 0 |

emulsion layer. The photographic materials were image-wise exposed through an step-wedge original using a $10^{-3}$ sec Xe flash. The exposed photographic materials were developed in a G101 commercial developer using a Rapiline 66-3 machine at 35 degree C for 25 sec, and fixed at 33 degree C for 25 sec in a G 333c commercial fixer to which a hardener (Aditan) was added. All the commercial products are trademarket names of Agfa-Gevaert.

The relative speed is expressed as the logarithm of the ratio of the illumination-energy needed in order to obtain an optical density equal to the density $D=(D_{max}-D_{min})/2$, i.e. at the density where about 50% of the coated silver halide is image-wise reduced relative to the energy to get the same density for the non-doped emulsion. Again, a positive number indicates that more energy is needed in the illumination in order to obtain the same optical density. A more positive number is therefor indicative for a less sensitive emulsion. The fog level is for all the materials low, i.e. 0.03 to 0.04. The contrast is measured around this

TABLE B.2

Sensitometric results of doping an AgCl crystal with a $RuCl_5NO$-dopant at different locations.

| | Location | Dye | Relative sens. | Relative contrast | |
|---|---|---|---|---|---|
| B1 | — | no | — | 100 | comp. |
| B2 | inner shell | no | .67 | 226 | invent. |
| B3 | outer shell | no | .87 | 100 | comp. |
| B1 | — | yes | — | 100 | comp. |
| B2 | inner shell | yes | .75 | 194 | invent. |
| B3 | outer shell | yes | .95 | 102 | comp. |

sensitivity point between 25% and 75% of density). The relative contrast is expressed as the ratio (in percentage) of the contrast of the doped emulsion versus the none doped emulsion. The sensitometric parameters are given in table B.2.

The silver bromide emulsions were ripened at a pAg and pH equal to 7.8 and 4.6 respectivily, with gold salt (5 $10^{-6}$ mole/mole Ag) and sulfur salt (8.6 $10^{-6}$ mole/mole Ag) at 50 degrees C for 150 minutes. After the addition of a green light-absorbing sensitizer the silver bromide were coated in a similar way as the AgCl emulsions B1 to B3. The exposure, processing and sensitometric evaluation of the photographic materials were performed in the same way as described as hereinbefore. The sensitometric parameters are given in table B.3 where next to the 'normal' contrast and sensitivity also the values for the 'shoulder', are given. The shoulder sensivitiy and contrast are measured in the same way as described hereinbefore in example 1.

TABLE B.3

The sensitometric results of an AgBr-emulsion doped with $K_2RuCl_5(NO)$ situated at different locations in the crystal

| | | Dye | Relative sens. | Rel. Contrast (%) | Relative Shoulder sens. | Relative Shoulder Contrast | |
|---|---|---|---|---|---|---|---|
| B4 | — | yes | — | 100 | — | 100 | Comparative |
| B5 | inner shell | yes | .28 | 122 | .22 | 121 | Invention |
| B6 | outer shell | yes | .66 | 68 | .47 | 116 | comparative |

The influence of the location of the dopant on the gradation and sensitivity of the doped emulsion is similar as observed in example 1. For AgCl there is a strong increase of the contrast by 'moving' the dopant from the outer region of the crystal (B3) to the core (B2) the sensitivity increases significantly as well. This happens in the emulsion with and without the presence of a spectral sensitizer. For the doped AgBr emulsion with spectral sensitization the same relationship is clearly established.

EXAMPLE 3

Preparation of emulsion C1:

| | | |
|---|---|---|
| Solution C1: | | |
| gelatin | 75 | g |
| demineralised water | 1500 | ml |
| Solution C2: | | |
| $AgNO_3$ | 750 | g |
| demineralised water | 1500 | ml |
| Solution C3: | | |
| NaCl | 257.7 | g |
| demineralised water | 1500 | ml |
| Solution C4: | | |
| NaCl | 228.87 | g |
| demineralised water | 1375 | ml |
| Sol. Dot4 | 125 | ml |
| Solution Dot3: | | |
| NaCl | 250 | g |
| acetic acid | 5 | ml |
| demineralised water added to make | 1 | liter |
| $Na_3RhCl_6.12H_2O$ | 17.04 | g |
| Solution Dot4: | | |
| NaCl | 250 | g |
| acetic acid | 5 | ml |
| demineralised water added to make | 1 | liter |
| $Na_3RhCl_6.12H_2O$ | 2.13 | g |

The pH of the solutions C1 and C3 was brought to a pH of 3.5 using a $HNO_3$ solution. The solutions C2 and C3 were kept at room temperature, while solution C1 was heated to 40 degree C. The pAg was set at a value of 7.95 using a sodium chloride solution. Solution C2 was added to solution C1 at a constant rate, while solution C3 was added at a rate in order to keep the pAg constant during 3 minutes. Afterwards solution C2 was added at an accelerated rate, while solution C3 was added at a rate sufficient to keep the pAg constant.

The resulting silver chloride was precipitated by adding a polystyrene sulphonic acid. The precipitate was rinsed several times by using a low concentrated NaCl solution (0.539 mg NaCl per liter demineralised water), and subsequently redispersed by adding 195 g of gelatin to the precipitate and chlorinated water in order to get a total weight of 3.250 kg.

The so prepared silver chloride emulsion has a homodisperse grain size distribution with a mean grain size of 0.20 $\mu$m and a variance in grain size of about 20%.

Emulsions C2 and C3 were prepared in the same way. For the precipitation of emulsion C2 the addition of 15.6 ml of solution Dot3 was carried out by using a third jet between the moments that respectivily 6 and 21% of the silver was added. Emulsion C3 was prepared identical to emulsion Cl except that for the precipitation solution C4 was used instead of solution C3.

Emulsion specifications are given in Table C.1.

The emulsions were further prefogged. Therefore the pH was adjusted at a value of 7.0 using NaOH and the pAg was set at 7.95 using a chloride solution. At 55 degrees C 9.676 $10^{-6}$ mole thioureumdioxyde was added per mole silver. After 15 minutes 1.241 $10^{-6}$ mole of a gold salt was added per mole of silver and after another minute 3.23 $10^{-6}$ mole of sodium toluenethiosulphonate was added per mole of silver. The fogging process was continued for 3 hours at this temperature.

TABLE C.1

$RhCl_6^{3-}$-dopant situated at different locations in an AgCl-crystal.

| Nr | | Mole Rh3 + /mole Ag | d (μm) | $d_1$ (μm) | FORM |
|---|---|---|---|---|---|
| C1 | none | 0 | 0.206 | — | 0 |
| C2 | 6–21% | 100 $10^{-6}$ | 0.211 | 0.125 | 16469 |
| C3 | 0–100% | 100 $10^{-6}$ | 0.200 | 0.200 | 0 |

Than 5.2 mmole per mole of silver of a nitrobenzimidazole-5(6) desensitizer was added to the emulsions followed by coating on a PET base in an amount of 3.5 g of silver and 2.2 g of gelatin both per $m^2$. A top layer containing hardener and surfactants was coated on the emulsion layer.

The photographic materials were image-wise exposed through an step-wedge original using a QL 100 LI equipement. Using a PRINTON LI the illumination time was adjusted to 150 units. The exposed photographic materials were developed in a G101 commercial developer using a Rapiline 66-3 machine at 35 degree C for 25 sec, and fixed at 33 degree C for 25 sec in a G 333c commercial fixer to which a hardener (Aditan) was added. All these commercial products are trademarket names of Agfa-Gevaert.

The practical evaluation of the relative speed and contrast were performed as described hereinbefore. The sensitometric parameters are given in table C.2.

The sensitometric results with a prefogged direct-positive AgCl emulsion clearly demonstrate, as was expected of the value of the parameter FORM (see equation II) that introducing the dopant in the core instead of in the outer regions of the crystal leads to a significant increase of the contrast without loosing sensitivity.

TABLE C.2

Sensitometric results of AgCl-emulsions in relation with different locations of a Rh-salt in the crystal.

| | Dopant | Sensitivity | Contrast (%) | |
|---|---|---|---|---|
| C1 | none | — | 100 | Comparative |
| C2 | 6–21% | .02 | 107 | Invention |
| C3 | 0–100% | .31 | 64 | Comparative |

EXAMPLE 4

Preparation of emulsion D1:

| | |
|---|---|
| Solution D1: | |
| gelatin | 25 g |
| demineralised water | 1000 ml |
| Solution D2: | |
| $AgNO_3$ | 250 g |
| demineralised water | 500 ml |
| Solution D3: | |
| NaCl | 85.91 g |
| demineralised water | 500 ml |

-continued

| | |
|---|---|
| Solution Dot5: | |
| NaCl | 58.44 g |
| acetic acid | 5 ml |
| demineralised water added to make | 1 liter |
| $Na_3RhCl_6.12H_2O$ | 17.04 g |

The pH of the solutions D1 and D3 was brought to a pH of 3.0 using a $HNO_3$ solution. The solutions D2 and D3 were kept at room temperature, while solution D1 was heated to 40 degrees C. The pAg was adjusted at 8.24 by using a sodium chloride solution. Solution D2 was added to solution D1 at a constant rate, while solution D3 was added at a rate in order to keep the pAg-value constant during 3 minutes. Afterwards solution D2 was added at an accelerated rate, while solution D3 was added at a rate sufficient to keep the pAg constant. The addition of 2.5 ml of dopant solution Dot5 was carried out by using a third jet between the moment that the first 10% of silver was reacted and te end of the precipitation. The resulting silver chloride was precipitated by adding a polystyrene sulphonic acid. The precipitate was rinsed several times by using a low concentrated NaCl solution (0.539 mg NaCl per liter demineralised water) and subsequently redispersed by adding 50 g of gelatin to the precipitate and chlorinated water in order to get a total weight of 1.250 kg.

The so prepared silver chloride emulsion has a homodisperse grain size distribution with a mean grain size of 0.14 μm and a variance in grain size of about 24%.

Emulsions D2 and D3 were prepared in the same way. For the precipitation of emulsion D2 the addition of 2.5 ml of solution Dot5 was carried out by using a third jet between the moments that respectivily 10 and 20% of the silver was added. For emulsion D3 was it between the moments that 90 and 100% of the silver was added. Emulsion specifications are given in table D.1.

Before chemical sensitizing the pH was adjusted at 5 by using NaOH while the pAg was adjusted at 7.27. The chemical sensitization was carried out at 45 degrees C by adding an amount of 2.14 $10^{-5}$ mole sulphur salt per mole silver halide and 1.48 $10^{-5}$ mole gold salt per mole silver halide while keeping the emulsion at this temperature for three hours.

TABLE D.1

Location and concentration of a Rh-dopant situated in an AgCl-crystal

| Nr | | $10^{-6}$ mole $Rh^{3+}$/mole Ag | Dopant-solution | d (μm) | $d_1$ (μm) | FORM |
|---|---|---|---|---|---|---|
| D1 | 10–100% | 48,237 | Dot5 | 0.147 | 0.147 | 0 |
| D2 | 10–20% | 48,237 | Dot5 | 0.139 | 0.081 | 7706 |
| D3 | 90–100% | 48,237 | Dot5 | 0.147 | 0.147 | 0 |

Than 5.2 mmole per mole of silver of a nitrobenzimidazole-5(6) desensitizer was added to the emulsions followed by coating on a PET base in an amount of 3.5 g of silver and 2.2 g of gelatin both per $m^2$. A toplayer containing hardener and surfactants was coated on the emulsion layer.

The photographic materials were image-wise exposed for 10 seconds through an step-wedge original using a CDL 1030 equipement on level 1. The development was carried out as described in example 3.

The relative speed is the logarithm of the ratio of the energy of the illumination needed to obtain an optical density equal to the 0.3 above fog level, relative to the illumination energy needed to get the same density for the emulsion with the dopants homogeneously spread in the crystal between 10 and 100% of the crystal volume. The contrast is measured in the foot of the sensitometric curve between reference densities 0.05 and 0.3 above fog level. The relative contrast is expressed as the ratio in percentage of the contrast of the doped emulsion versus the emulsion with the dopants homogeneously spread in the crystal between 10 and 100% of the crystal volume. The sensitometric parameters are given in table D.2.

TABLE D.2

Sensitometric results of a Rh-doped AgCl-emulsion as a function of the location of the dopant.

| | Dopant-solution | Location | Rel. Sens. | Rel. Contrast | |
|---|---|---|---|---|---|
| D1 | Dot5 | 10–100% | — | 100 | Comparative |
| D2 | Dot5 | 10–20% | .08 | 105 | Invention |
| D3 | Dot5 | 90–100% | .83 | 44 | Comparative |

As can be seen in this experiment and as expected from the value of the parameter FORM (equation II), the activity of the electron trap increases rapidly by 'moving' the dopant from the outer regions to the center of the crystal.

While the invention has been described in detail and with reference to specific embodiments thereof, it will be apparant to one skilled in the art that various changes and modifications can be made therein without departing from the spirit and the scope thereof.

What is claimed is:

1. A photosensitive image-forming element comprising on a support at least one photosensitive layer containing silver halide crystals internally doped in the center of the crystal volume with a transition metal complex while forming a deep and permanent electron trap providing an incorporated molecular entity having a trapping lifetime whereby the lowest unoccupied molecular orbital of the incorporated molecular entity is at least 0.5 eV below the conduction band of the silver halide crystal, and the trapping lifetime at room temperature is longer than 0.2 seconds and satisfying the equation (I):

$$0<FORM<10^{+5} \quad (I)$$

wherein $$FORM = \left(\frac{d_1}{d}\right)^3\left[1-\left(\frac{d_1}{d}\right)^3\right]Q \quad (II)$$

wherein $d_1$ represents a spherical equivalent diameter (SED), expressed in $\mu$m, corresponding with a central part of said crystal doped with the said transition metal complex, d expressed in $\mu$m represents the spherical equivalent diameter of the whole crystal volume, while Q represents the concentration of the transition metal complex, expressed in $10^{-9}$ mole per mole of silver halide and wherein the said transition metal complex has the following general formula (1):

$$[MX_nY_mL_q]^{r-} \quad (1)$$

wherein:

M represents a metal selected from the group consisting of an element from Group 5 up to Group 10 of the Periodic System of the Elements;

X and Y, which are different from each other, each represents one of the elements from the group consisting of Cl, Br and I;

L represents any anorganic or organic ligand;

n and m each equals an integer having a value from 0 to 6, while n+m equals 4, 5 or 6;

q equals 0, 1 or 2 so that n+m+q=6 and r equals 1, 2, 3 or 4 whereby from about 3 to about 75 volume percent of said transition metal complex is located in the inner region of the crystal volume.

2. A photosensitive image-forming element according to claim 1, wherein in the general formula (1) of the transition metal complex represents a ligand L selected from the group consisting of NO, NS, OH, $H_2O$, CN, CO, $CH_3CN$, CNS, NCS, $NO_2$, F, SeCN, CNSe, TeCN, CNTe, OCN, CNO, $N_3$ and COO.

3. A photosensitive image-forming element according to claim 1, wherein the spherical equivalent diameter (SED) is not more than 1 $\mu$m.

4. A photosensitive image-forming element according to claim 1, wherein the spherical equivalent diameter (SED) is not more than 0.5 $\mu$m.

5. A photosensitive image-forming element according to claim 1, wherein the said silver halide crystals comprise at least 10 mole % of chloride.

6. A photosensitive image-forming element according to claim 1, wherein the said silver halide crystals comprise at least 50 mole % of chloride.

7. A photosensitive image-forming element according to claim 1, wherein the said silver halide crystals contain one or more additional dopant(s) differing from the one described in formula (1) in that their electron-trapping activity is non-permanent.

8. A method for obtaining a photosensitive image-forming element according to claim 1, comprising the steps of:

precipitation of silver halide emulsion crystals wherein one or more dopant(s) according to the general formula (1) are added in such a way that location and concentration of the said dopant(s) satisfy equations (I) and (II), chemically ripening and/or fogging said crystals while spectral sensitizing or desensitizing said emulsion, and coating the said emulsion on at least one side of a support.

9. A method for obtaining an image, comprising the steps of information-wise exposing a photosensitive image-forming element as defined in claim 1 and subsequently processing said information- wise exposed photosensitive image-forming element in the presence of ascorbic acid or a derivative thereof as an ecological developing agent(s) and silver halide solvent(s).

10. A method according to claim 9 using a developer comprising both hydroquinone and ascorbic acid or a derivative thereof.

11. The element of claim 1 wherein from about 5 to about 50 volume percent of said transition metal complex is located in the inner region of the crystal volume.

12. The element of claim 1 wherein from about 6 to about 21 volume percent of said transition metal complex is located in the inner region of the crystal volume.

* * * * *